United States Patent [19]

Schubart et al.

[11] Patent Number: 4,870,884

[45] Date of Patent: Oct. 3, 1989

[54] INCENDIARY PROJECTILE, METHOD OF INTRODUCING THE INCENDIARY COMPOSITION INTO THE PROJECTILE AND ARRANGEMENT FOR IMPLEMENTING THE METHOD

[75] Inventors: Rudolf Schubart; Wolfgang Schwarz, both of Nuremberg, Fed. Rep. of Germany

[73] Assignee: Diehl GmbH & Co., Nuremberg, Fed. Rep. of Germany

[21] Appl. No.: 219,664

[22] Filed: Jul. 15, 1988

[30] Foreign Application Priority Data

Jul. 29, 1987 [DE] Fed. Rep. of Germany ..... 3725091

[51] Int. Cl.[4] ..... C06D 1/08; F42B 3/00; B41F 31/02

[52] U.S. Cl. ..... 86/20.12; 29/1.22; 29/1.23; 86/20.1; 86/20.14; 102/364; 102/492; 102/506; 149/109.6

[58] Field of Search ..... 86/20.14, 20.15, 20.12, 86/20.1, 32; 29/1.21, 1.22, 1.23; 102/364, 492, 494, 495

[56] References Cited

U.S. PATENT DOCUMENTS

| | | | |
|---|---|---|---|
| 3,566,790 | 3/1971 | Knight, Jr. | 86/20.14 |
| 3,959,041 | 5/1976 | Knapp | 149/2 |
| 3,981,243 | 9/1976 | Doris, Jr. | 102/364 |
| 3,994,752 | 11/1976 | Hayes | 86/20.14 |
| 4,015,355 | 4/1977 | Schiessl et al. | 86/20.14 |
| 4,015,529 | 4/1977 | Knapp | 86/20.14 |
| 4,381,692 | 5/1983 | Weintraub | 86/20.12 |
| 4,383,468 | 5/1983 | Sie et al. | 86/1.1 |
| 4,579,059 | 4/1986 | Flatau | 102/503 |
| 4,689,185 | 8/1987 | Lopata et al. | 264/3.4 |

FOREIGN PATENT DOCUMENTS 811327 8/1951 Fed. Rep. of Germany .

*Primary Examiner*—Howard J. Locker
*Attorney, Agent, or Firm*—Scully, Scott, Murphy & Presser

[57] ABSTRACT

An incendiary projectile possessing an incendiary composition arranged locally bonded about the internal casing surface of the projectile wall structure. The projectile has the inner casing surface of its wall structure covered with the incendiary composition in fixed adherence therewith, and the explosive in the inner space of the projectile extends into grid-structured interspaces or scorings for the mutual bounding of covered regions. In this connection, there is also disclosed a particularly advantageous method for the formation of a projectile which is designed in this manner, as well as an expediently employable arrangement for the implementation of the method.

10 Claims, 1 Drawing Sheet

INCENDIARY PROJECTILE, METHOD OF INTRODUCING THE INCENDIARY COMPOSITION INTO THE PROJECTILE AND ARRANGEMENT FOR IMPLEMENTING THE METHOD

BACKGROUND OF THE INVENTION

1. Field of the Invention

The present invention relates to an incendiary projectile possessing an incendiary composition arranged locally bounded about the internal casing surface of the projectile wall structure.

2. Discussion of the Prior Art

A projectile of the type under consideration herein is known from the disclosure of U.S. Pat. No. 3,981,243, wherein the head space or nose cone of a casing which encompasses a penetrator core is filled with an incendiary mix or composition. In order to enable the effective attacking of combustible materials which are located behind the outer wall structure of a target, the core is provided with grooves along its surface with grooves extending at an incline or spirally relative to the cross-sectional plane of the core, and which are similarly filled with an incendiary composition. In that manner, it is intended to achieve that the incendiary composition will not only be effective during penetration into the casing of the target object, but will also be transported along by the core into the innerspace of the target object, in order to more assuredly lead therein to the ignition of combustible materials, especially such as fuel supplies or tanks.

SUMMARY OF THE INVENTION

Accordingly, it is an object of the present invention to so develop a projectile of the type which is under consideration herein, so as to produce in the target objects possessing comparatively weak armoring, especially such as sea-vessels and aircraft, a significantly improved synergistic effect from kinetic and thermal energy.

The foregoing object is achieved in that the projectile pursuant to the inventive concept has the inner casing surface of its wall structure covered with the incendiary composition in fixed adherence therewith, and the explosive in the inner space of the projectile extends into grid-structured innerspaces for the mutual bounding of covered regions. In this connection, the invention is also directed to a particularly advantageous method for the formation of a projectile which is designed in this manner, as well as to an expediently employable arrangement for the implementation of the inventive method.

In accordance with the foregoing, it is possible to obtain an overall highly-effective explosive and incendiary projectile, whose casing will disintegrate into highly-effective fragments of relatively good constructively predeterminable size and configuration, with a fixedly adherent covering of incendiary compositions on the rear side of the fragments. As a result thereof, on the one hand, there is assured that the incendiary composition will also be actually transported into the interior of the target upon the piercing of the target casing through the intermediary of the fragment; in essence it, is able to bring into action thermal energy within the casing of the target in addition to the kinetic energy; while, on the other hand, at the selection of an easily ignitable incendiary composition, the development of the reaction gas along the rear side of the fragment will preclude a reduction in the velocity and thereby in the energy of the fragment, inasmuch as any braking vortex and subpressure effects are inhibited on the rear side of the fragments due to formation of the incendiary gas.

The equipping of the internal jacket or mantle surface of the projectile casing with the incendiary composition is preferably carried out through a centrifugal casting method, inasmuch as this allows for the attainment of a mechanically particularly stable homogeneous bonding with the wall structure of the projectile, and subsequently with the fragments which are produced therefrom, inasmuch as the incendiary composition will not loosen or detach itself therefrom during the penetration of the fragments into the structure of the target. The geometry of the fragment formation is essentially determined by the cutting out or scoring of a grid-like matrix structure during the introduction of the incendiary composition on the inner jacket surface of the projectile casing. Through the grid structure which partitions the incendiary composition covering into individual mutually-bounded areas, there is determined the sequence in the ripping open of the wall material (in effect, the fragment formation), inasmuch as the material will preferably tear along such transitional regions between different mechanical damping conditions (between covered and not covered wall material). Through this effect in the influencing of the fragment structure, the cutting out of a grid structure intermediate the covering regions imparts the advantage that there is an increase in the volume which is to be filled with explosive for a projectile of a given caliber (in contrast with a continuous covering of the inner wall structure), and thereby it is possible to further increase the kinetic energy of the fragments which are accelerated by the explosive.

The cutting out or scoring of the grid structure is expediently effected during the course of the centrifugal introduction of the incendiary composition, subsequent to the application of a suitable auxiliary material aid structure, preferably in the form of wax ribs. However, an applicable wax rib network can only be introduced with difficulty, without being destroyed, into the interior space of the projectile and positioned in place therein, the formation of such a grid or network structure being expediently carried out through the intermediary of an axially-parallel divided, and thereby radially outwardly expandable or closable matrix with a groove profiling on its surface in conformance with the intended structure, and into which there is introduced the aid material (such as the liquified wax). Upon the radial drawing together of the matrix, i.e. reduction in diameter, the thereby formed rib structure remains in adherence with the inner jacket or mantle surface of the projectile casing, and during the subsequent centrifugal casting in of the incendiary composition serves as a nucleus or core for the cutting out or scoring of the grid structure in this covering. In comparison with the known loose inserting or glueing in of externally preformed incendiary composition sections or bodies, there is obtained a geometrically more readily predeterminable configuration of the incendiary composition covering, with an intimate bonding to the material of the future fragments, in contrast as would the case of a moisture or vapor-free adhesive bonding obtainable in the prior art.

When, in connection with the present invention, reference is made in general with regard to an incendiary composition, this does not represent any restriction to an incendiary composition in the narrower sense as being constituted from an oxidizer and a reducing medium. Preferably, this cast-in and, in essence, especially good adhering, structured internal covering with a defined cut out or scored grid structure is, namely, constituted of a so-called active incendiary material, which essentially consist of only the reducing medium, which reacts with the hot fuel gas clouds upon the detonation of the explosive, and thereafter maintains the incendiary reaction, inasmuch as the surrounding air serves as the oxidizer. Adapted as such easily ignitable active incendiary compositions which burn down at a high degree of temperature, are especially those zirconium or titanium alloys which are sold by Quantic Industries, Inc., San Carlos, California, USA, under the commercial designations QAZ/QAT; whereby the utilization of titanium as the basic material, besides the good incendiary effect also presents the economic advantage that, from the employment of welding electrode remainders, it is available relatively inexpensively and in large quantities, and can be easily worked in a centrifugal casting process. However, any other pyrophoric; in essence, incendiary-active materials can be centrifugally cast into the projectile, within the scope of the present invention, as an incendiary composition 20 covering with a pregiven grid structure especially such as the so-called cermix metals, or misch metals, a mixture of rare-earth metals which readily react with oxygen, inasmuch as because of its easy ignitability and high combustion heat it is available as a basic material for pocket lighter flints.

BRIEF DESCRIPTION OF THE DRAWINGS

Additional alternatives and modifications, as well as further features and advantages of the invention, can now be readily ascertained from the following detailed description of an exemplary embodiment thereof, taken in conjunction with the accompanying drawings; in which.

DETAILED DESCRIPTION

Figure 1:
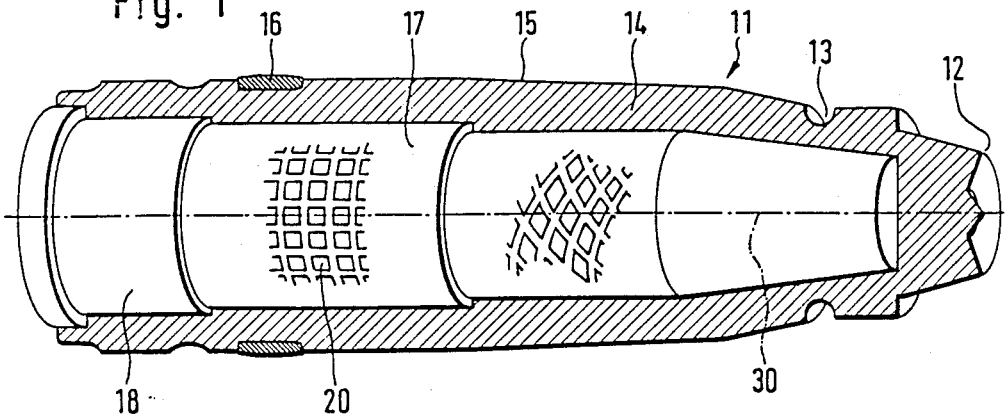
FIG. 1 illustrates, in a perspective view, an axial longitudinal section through the interior of an inventively equipped projectile, shown prior to the introduction of the incendiary composition and of the explosive.

The projectile 11 which is illustrated in the drawing as an exemplary embodiment for the attaining of the inventive object, is equipped with a gripping edge 12 at its front end with regard to its external contour configuration, in order to most possibly prevent any shipping off upon an angled impact against a target object. A rupturing or breaking location 13 serves for the disintegration of the projectile 11 upon an angled impact against a target, so that even at an tangential diversion of the target surface, there is still asserted a most extensively possible fragmentation effect. For this purpose, the projectile wall is preferably constituted from a ductile steel. For a spin stabilized deployment as a result of firing from a rifled weapon barrel or launch tube, the outer casing surface 15 of the projectile 11 is, in a known manner, equipped with a sealing or guide ring 16.

Figure 2:
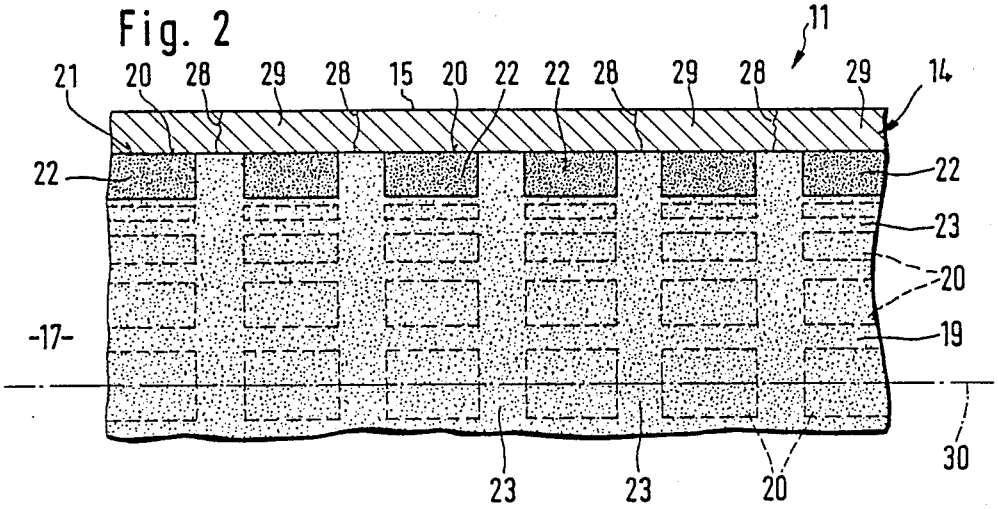
FIG. 2 illustrates, on an enlarged scale, a fragmentary portion of the axial longitudinal section pursuant to FIG. 1, with the projectile being shown after the introduction of the incendiary composition of the explosive.

The interior space 17 of the projectile is closed off towards its tail end by means of a form-fitted or load-transmissive base 18 which is fitted therein. The interior space 17, for the remainder, is filled with an explosive 19 (as shown in FIG. 2); with the exception of individual mutually-bounded regions or areas 20 on the inner jacket surface 21 of the projectile casing wall 14, which are covered with a herein generally dissipated incendiary composition 22. The channel-like or grid-shaped structure 23 which separates the covering regions 20 on the inner jacket surface 21 from each other, and into which there can extend the filling constituted of the explosive 19 up to against the inner jacket surface 21, can basically possess any suitable geometric configuration; in FIG. 2 and towards the left in FIG. 1, there is illustrated an axially-parallel and transversely thereto extending passageway structure 23; whereas in contrast therewith, in FIG. 3 and in FIG. 1 towards the right, a structure 23 which is angled relative to the cross-sectional plane.

Figure 3:
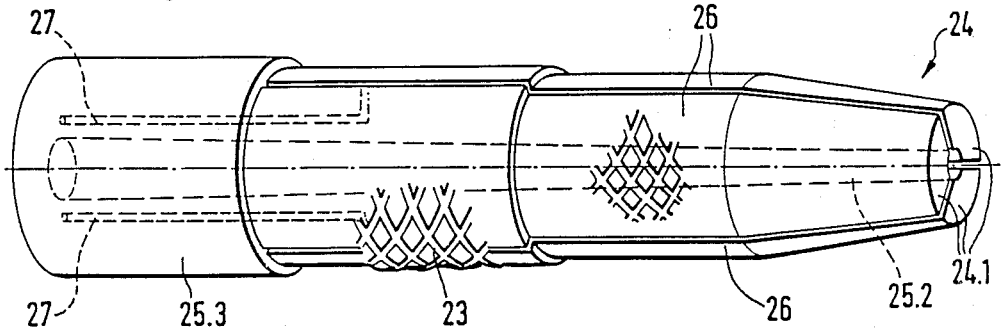
FIG. 3 illustrates, in a perspective view, a simple exemplary embodiment of a matrix for the introduction of a grid-shaped auxiliary structure on the internal jacket surface of the projectile prior to the application of the incendiary composition.

In order to define the spacer or grid structure 23 intermediate the regions 20 which are to be covered along the inner jacket surface 21 of the projectile casing wall, there is provided an axially-parallel multiple-divided matrix, somewhat pursuant to FIG. 3 which, when the base 18 is removed, and is insertable through tail end into the not yet filled interior space 17 of the projectile, and by means of a spreader or expansion tool 25, such as generally in the shape of a slightly conical axial mandrel 25.2, can be radially expanded. By means of a driving or rotating element 25.3, the individual matrix segments 24.1 are, in essence, radially displaced from each other by the worktool mandrel 25.2 up to contact of their external jacket surfaces 26 against the inner jacket surface 21 of the projectile. In accordance with the pattern, pursuant to which later on the grid structure 23 is to be cut out intermediate the covered regions 20 for the receipt of explosive 19, the matrix 24 possesses corresponding passageway structures 23 about its outer jacket or mantle surface 26. These are also filled with an aid medium, especially such as wax, after the removal of the driving element 25.3, possibly through feed passageways 27. Inasmuch as the outer jacket surface 26 of the matrix, but not the inner jacket or mantle surface 21 of the projectile is sanded, for instance, with a ceramic dust or powder as a separating medium, or the expanding mandrel 25.2 is heated, this auxiliary medium adheres substantially better to the inner jacket surface 21 and is maintained thereon as a grid structure 23 when, subsequent to the removal of the spreader or mandrel 25.2, the matrix segments 24.1 are radially inwardly displaced by at least the height of the passageway structure 23, and then are again drawn out rearwardly axially-parallel from the sleeve; in effect, out of the projectile 11.

The incendiary composition (in the above-defined course) can now be introduced into the interior space 17 of the projectile and, preferably in the way of the known centrifugal casting method, applied in an extremely good bounding hermetically fixed intermediate the grid structure 3 onto the inner casing surface 21 of the projectile. When the auxiliary or aid material in the form of the grid structure 23 is thereafter removed (for example, rinsed out or molten out) remaining on the projectile inner casing or jacket surface 21 are the mutually bounded incendiary composition regions 20. During the subsequent filling, such as through melting-in, of the interior space 17 of the projectile with explosive 19, the cut-out grid structure 23 between the covered regions 20 is then also filled with explosive 19; in essence, the entire inner space 17, up to the inner jacket surface 21 of the wall casing and thereafter the projectile 11 is closed off at its rear side with the base 18.

Upon the detonation of the explosive 19 due to striking against a target or penetrating into a target by the projectile 11, there will be encountered rupturing fissures 28 along preferably the path of the grid structure 23 on the inner casing or jacket surface 21; namely, due to the damping rupture between covered regions 20 and the not covered spacer structures 23 in view of the radially outwardly directed explosion pressure effect of the detonated explosive 19. Consequently, the wall structure 14 of the projectile casing is disintegrated into radially accelerated fragments 29, which because of the predetermination of the grid structure 23 can be imparted relatively predefinable constructive sizes and distribution along the longitudinal axis 30 of the projectile. Due to the extremely good, homogeneous bounding along the inner casing between the accelerated fragments 19 and the rearwardly adhering incendiary composition covering 22, the last-mentioned is torn along therewith; in effect, especially after the penetration of the fragments is carried into the interior of a target object. From this, besides the gas impact and the fragment penetrating effect, there results an incendiary effect, such as for the igniting of ammunition and especially fuel supply tanks.

When, as intended, because of the material selection for the incendiary composition covering 20, it is assured that the ignition thereof will already occur upon the breaking open of the wall 14 into the outwardly accelerated fragments 29, the reaction gases which are generated by the burning-down covering 22 will, in addition produce a reduction in the base suction effect on the accelerated fragments 29 and thereby an increased kinetic energy at the penetrating of the fragments 29 into a target, in comparison with fragment components which, under otherwise similar conditions, are exposed to a tail end suction effect.

What is claimed is:

1. A method for the production of a projectile having a structured coating of an incendiary composition on its inner mantle surface, said projectile having an explosive material filler for defined fragmentation disintegration of its wall structure; said explosive material filler extending to said structured coating; said coating defining a grid-shaped channel structure; said method comprising the steps of:

introducing a segmented matrix into the projectile which defines recesses;

introducing a removable auxiliary material to fill said recesses of said matrix and adhere to said inner mantle surface of said projectile;

removing said matrix from said auxiliary material structure to expose said mantle not coated by said auxiliary material;

coating said mantle surface exposed upon removal of said matrix with said incendiary composition by a centrifugal casting process, such that incendiary composition is divided into regions throughout the structure;

removing the auxiliary material structure; and filling said projectile with said explosive material filler;

such that said explosive material filler contacts and adheres to said inner mantle exposed upon removal of said auxiliary material.

2. A method as claimed in claim 1, wherein the auxiliary material is introduced by an axially-parallel divided, diametrically variable matrix having a grooved passageway structure along its outer surface.

3. A method as claimed in claim 1, further including the steps of introducing an expendable matrix into the interior of the projectile, said matrix including radially adjustable segments, wherein the outer jacket of said matrix has a grid-shaped passageway structure formed thereon which conforms with the shape of said coating of said incendiary composition.

4. A method as claimed in claim 1 wherein said incendiary composition covering is arranged in locally bounded regions along the inner casing surface of the projectile wall; and wherein the incendiary composition adheres to said inner casing surface of the wall.

5. A method as claimed in claim 4, wherein an explosive material in the interior of the projectile extends into grid-structured innerspaces formed upon removal of said auxiliary material.

6. A method as claimed in claim 1, wherein said auxiliary material on the inner casing surface of the wall which is to be subsequently filled with an explosive, is formed from a curable and thereafter removable material.

7. A method as claimed in claim 1, wherein said incendiary composition is active and comprises a reduction medium.

8. A method as claimed in claim 7, wherein said incendiary composition comprises a pyrophoric material.

9. A method as claimed in claim 7, wherein said incendiary composition comprises a zirconium or titanium alloy.

10. A method as claimed in claim 7, wherein said incendiary composition comprises a misch metal.

* * * * *